US007815393B2

(12) United States Patent
Snyder et al.

(10) Patent No.: US 7,815,393 B2
(45) Date of Patent: Oct. 19, 2010

(54) MOUNTING ADAPTER FOR CONCRETE SURFACE PROCESSING TOOL

(75) Inventors: Jeffrey L. Snyder, York, PA (US); Brett L. Miller, Dallastown, PA (US)

(73) Assignee: Wagman Metal Products, Inc., York, PA (US)

( * ) Notice: Subject to any disclaimer, the term of this patent is extended or adjusted under 35 U.S.C. 154(b) by 186 days.

(21) Appl. No.: 12/220,428

(22) Filed: Jul. 24, 2008

(65) Prior Publication Data

US 2009/0028643 A1 Jan. 29, 2009

Related U.S. Application Data

(60) Provisional application No. 60/961,862, filed on Jul. 25, 2007, provisional application No. 61/065,954, filed on Feb. 16, 2008.

(51) Int. Cl.
*E01C 19/22* (2006.01)
*A47L 11/00* (2006.01)
*B24B 41/00* (2006.01)

(52) U.S. Cl. ..... 404/112; 15/49.1; 451/342

(58) Field of Classification Search ..... 404/112, 404/86, 133.2; 451/353, 342, 343; 15/49.1, 15/98

See application file for complete search history.

(56) References Cited

U.S. PATENT DOCUMENTS 1,988,193 A * 1/1935 Edstrom ..... 451/353
2,759,305 A * 8/1956 Helbig ..... 451/356
3,044,091 A * 7/1962 Nishihama ..... 15/49.1
4,097,950 A * 7/1978 Satterfield ..... 15/49.1
4,317,314 A * 3/1982 Carlstrom et al. ..... 451/353
4,319,434 A * 3/1982 Brejcha ..... 451/353
4,719,659 A * 1/1988 Urakami ..... 15/49.1
4,799,282 A * 1/1989 Fischer ..... 15/98
6,238,277 B1 * 5/2001 Duncan et al. ..... 451/271
6,425,169 B1 * 7/2002 Briscoe ..... 29/90.01
6,783,447 B2 * 8/2004 Van Vliet et al. ..... 451/353
7,377,838 B1 * 5/2008 Van Vliet ..... 451/353
7,481,602 B2 * 1/2009 Lampley et al. ..... 404/112

* cited by examiner

*Primary Examiner*—Thomas B Will
*Assistant Examiner*—Abigail A Risic
(74) *Attorney, Agent, or Firm*—Stuart J. Friedman

(57) ABSTRACT

A mounting assembly for rotatably mounting a surface processing tool holder on at least one motor driven rotatable arm of a surface processing apparatus, such that the tool can spin freely as the arm is driven by the motor, includes an elongate shank having a smooth surfaced, cylindrical portion intermediate its ends adapted for positioning within an aperture in the tool holder with one threaded end portion projecting through the aperture for attachment to an elongate mounting bar adapted for attachment to the arm. A bearing supported by the tool body and surrounding the smooth surfaced portion of the shank is rotatable relative to the shank. The mounting bar includes a threaded aperture for receiving the threaded end portion of the shank and the threaded aperture includes a counterbore for receiving the end portion of the smooth surfaced shank portion which is adjacent the threaded end portion.

18 Claims, 6 Drawing Sheets

MOUNTING ADAPTER FOR CONCRETE SURFACE PROCESSING TOOL

CROSS-REFERENCE TO RELATED APPLICATIONS

This is a non-provisional application based upon U.S. provisional applications Ser. No. 60/961,862, filed Jul. 25, 2007, now pending, and Ser. No. 61/065,954, filed Feb. 16, 2008, now pending.

FIELD OF THE INVENTION

The present invention relates to surface processing machines for mounting surface processing tools and, more particularly, to mounting means for rotatably mounting circular brushes on the arms of motor driven spider arm assemblies of such machines.

BACKGROUND OF THE INVENTION

Typically, when large area concrete floors are installed, they may be surface finished, e.g., texturized, cleaned, prepared for subsequent application of a penetrating sealer or other substance, using a surface processing machine, such as conventional walk behind floor polishing-type machines 20 comprising a gas or electric engine 22, a handle 24 for machine control and steering and a circular rotating brush 26 driven by engine 22, as shown in FIG. 1. Such machines have a typical finished area per revolution of less than 20 square feet. When it is appreciated that large warehouse floors may be hundreds of thousands of square feet, it can be seen that performing a finishing operation on large area floors using walk behind type brush machines will either take a very long time or require many operators and machines.

It is known that during the installation of concrete floors, the troweling and finishing operation is performed on the wet concrete using either walk-behind or ride-on power trowels. Inasmuch as at least one type of power trowel machine is generally already on site during the installation of concrete floors, the present invention seeks to use the on-site availability of these machines for surface finishing purposes. In addition, generally, concrete contractors do not have floor polishing machines on site and typically do not own such machines. Therefore, where conventional floor polishing machines are used to surface finish concrete surfaces, concrete contractors have to invest in and own or lease separate, expensive pieces of equipment.

In one of its forms, the present invention takes advantage of the larger finished area attainable with ride-on power trowel machines by converting these power trowel machines to surface finishing machines suitable for tasks other than troweling. Ride-on power trowel machines typically range in size from approximately 6 feet to slightly more than 10 feet in width and produce a troweled area of up to 40 square feet. The largest units weigh more than a ton and can finish about 30,000 square feet per day. Ride on trowels, such as the trowel machine illustrated in FIG. 2, can be configured with two or more rotors, each having a plurality of radially oriented, spaced-apart arms and a trowel blade mounted on each arm. The blades on adjacent rotors may be overlapping or non-overlapping. A typical four arm spider assembly suitable for use with either a ride-on or walk-behind power trowel is illustrated in FIG. 3. The assembly includes four radially extending arms emanating from a central hub, which receives a drive shaft. A trowel blade is mounted directly via bolts or indirectly via a mounting bar on each of the arms. Concrete surface processing machines having spider assemblies for non-rotatably mounting trowel blades, and the manner of attachment of the trowel blades to the spider arms are discussed in detail in U.S. Pat. No. 7,059,801—Snyder et al, the disclosure of which is incorporated herein by reference. Another means for rotatably mounting surface processing tools to spider arms is disclosed in U.S. Pat. No. 4,319,434—Brecha.

Converting walk-behind or ride-on troweling machines to surface finishing machines involves providing mounting means which allows the rapid, on-site substitution of finishing tools, such as circular brushes, on the spider arms in place of the trowel blades which were used during the installation of the concrete floor. The mounting means of the present invention has the advantage that it can mount surface processing tools, such as scrubbing, brushing, buffing, grinding and polishing tools, on the spider arms using readily available hand tools in a very short period of time without need for heavy or expensive equipment. The surface finishing tools are mounted to each of the spider arms, desirably using a mounting bar, in such a way that, as the spider arms rotate about the hub, each of the surface polishing tools, e.g., circular brushes, on each arm is free to spin about a mounting axis perpendicular to the spider arms and parallel to the axis of rotation of the spider arms. By allowing circular brushes to rotate freely about the axis, the brushes will wear more uniformly than if they were rigidly mounted to the arms.

SUMMARY OF THE INVENTION

Figure 1:
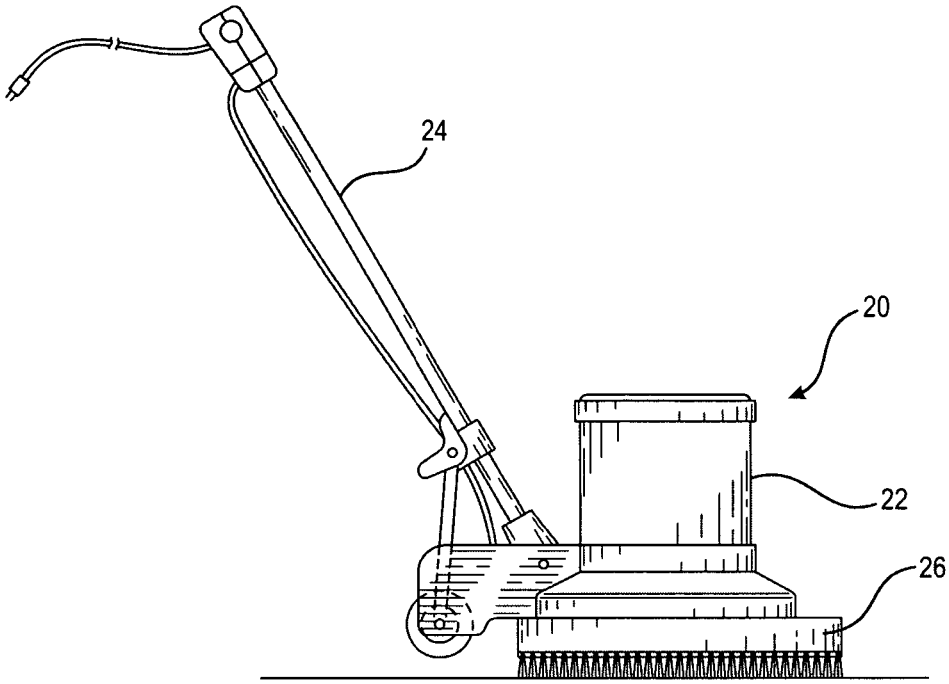
FIG. 1 is a perspective view of a walk behind floor polishing type machine.
Figure 11:
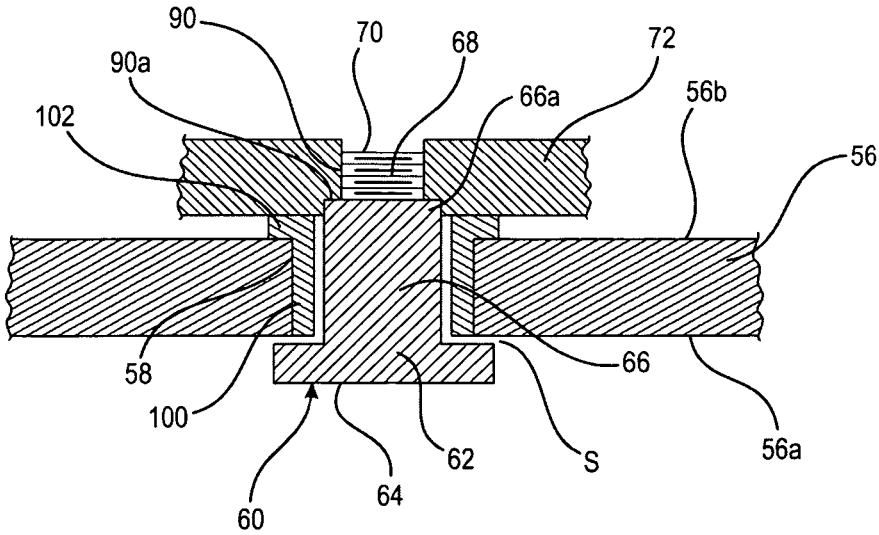
FIG. 11 is a partial sectional view taken along line B-B in FIG. 9.

It is, therefore, a primary object of the present invention to provide a mounting adapter for surface processing tools which allows their use on conventional power trowel machines having spider assembly arms.

It is another object of the present invention to provide a mounting adapter which allows advantage to be taken of the presence at a concrete floor construction site of high square footage capacity power trowel machines for surface processing purposes.

It is still another object of the present invention to provide a mounting adapter which allows the rapid, on-site substitution of surface processing tools on spider arms in place of the trowel blades used during concrete floor installation.

It is yet another object of the present invention to provide a mounting adapter for surface processing tools on spider assemblies which allows the surface processing tools to spin freely about their axes while the spider arms are rotatably driven in order to encourage more uniform wear of the tools and a longer useful life.

It is another object of the present invention to provide a mounting adapter which greatly increases the strength of the attachment between the mounting shank and the mounting bar and between the mounting bar and the spider arm.

The foregoing and other objects are achieved in accordance with the present invention by providing a mounting assembly for rotatably mounting a tool holding means comprising a tool holder body having first and second surfaces, a surface processing tool mounted on said first surface and an aperture extending through said second surface, on at least one motor driven rotatable arm of a surface processing apparatus, on an axis substantially parallel to the axis of rotation of said motor driven arm, whereby said surface processing tool can spin freely about its axis as said arm is rotatably driven by said motor, said mounting assembly comprising:

elongate shank means including an elongate smooth surfaced, generally cylindrical shank portion intermediate the ends of said shank means, said shank means adapted for positioning within said aperture with one end projecting through said second surface of said tool holder body;

bearing means supported by said second surface of said tool body and surrounding said smooth surfaced portion of said shank means;

elongate mounting means adapted for attachment to said arm, said one end of said elongate shank means including means for non-rotatable attachment to said mounting means;

said bearing means being rotatable relative to said shank means for rotatably mounting said surface processing tool, whereby said surface processing tool can spin freely about its axis.

In accordance with one aspect of the invention, the elongate mounting means includes a threaded aperture for receiving the threaded end portion of the shank means within the threaded aperture and the threaded aperture includes a counterbore for receiving the end portion of the smooth surfaced portion which is adjacent the threaded end portion.

In accordance with another aspect of the invention, the bearing means includes first and second relatively rotatable, concentric hubs, the first hub being supported by the second surface of the tool holder body such that the bearing means is concentric with the aperture therein, the first hub has a first central bore, the second hub has a second central bore concentric with the first central bore and is mounted within the first central bore and the elongate shank means extends through the second central bore with the threaded end portion of the shank and the end portion of the smooth surfaced portion which is adjacent the threaded end portion projecting from the second central bore and received by the threaded and counterbored aperture in the mounting means.

In accordance with still another aspect of the invention, the bearing means comprises a hollow cylindrical, elongate sleeve having an outside diameter smaller than the diameter of the aperture in the tool holding means and a circular flange extending radially outwardly from the periphery of one end of the sleeve for maintaining the sleeve within the aperture and the elongate shank means extends through the sleeve with the threaded end portion of the shank and the end portion of the smooth surfaced portion which is adjacent the threaded end portion projecting from the sleeve and received by the threaded and counterbored aperture in the mounting means.

DETAILED DESCRIPTION OF THE INVENTION

Figure 2:
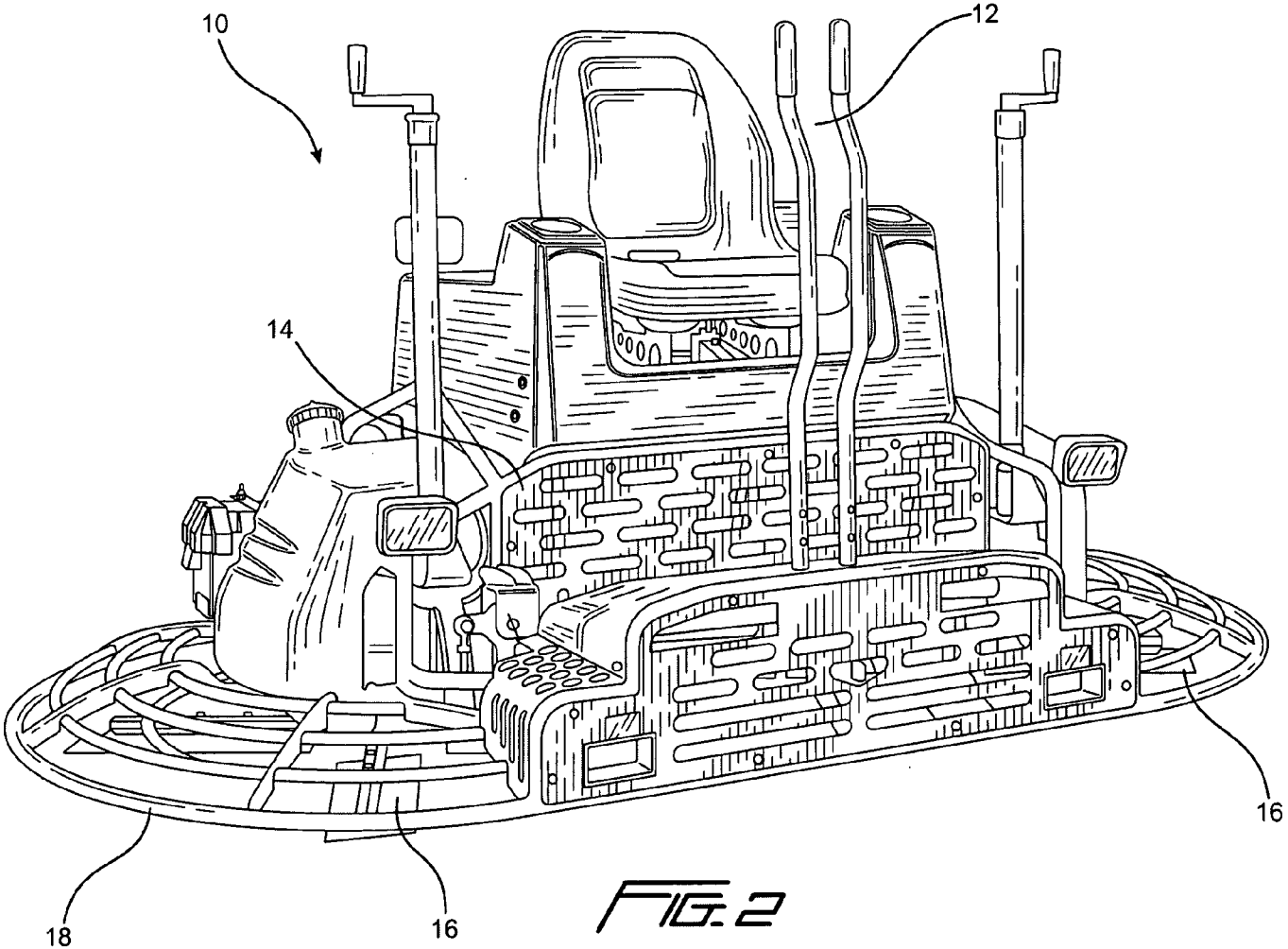
FIG. 2 is a perspective view of a ride-on power trowel.
Figure 3:
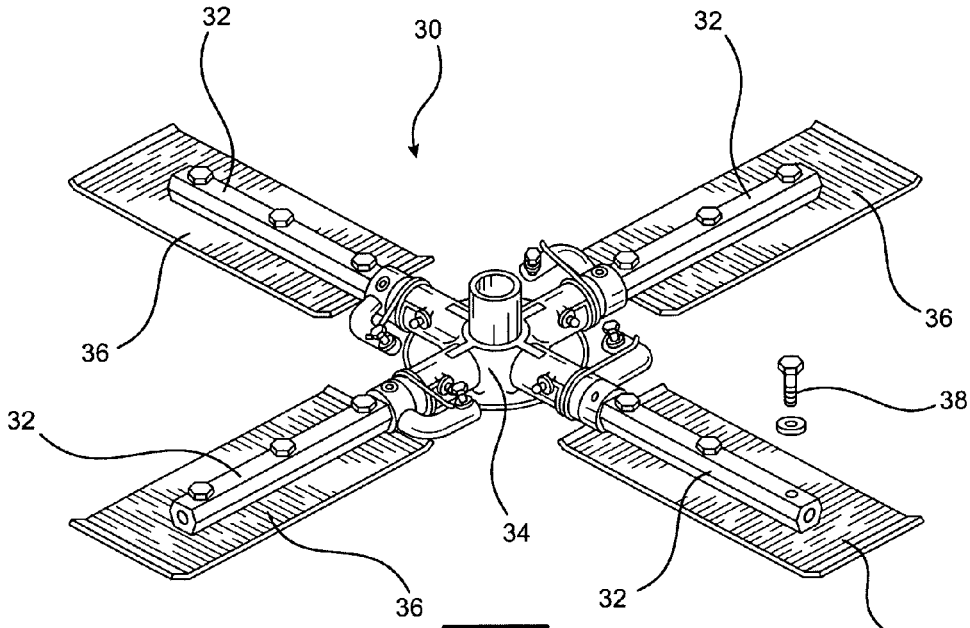
FIG. 3 is a top perspective view of a four arm rotor assembly mounting four trowel blades and suitable for use with ride-on surface processing machines of the present invention.
Figure 5:
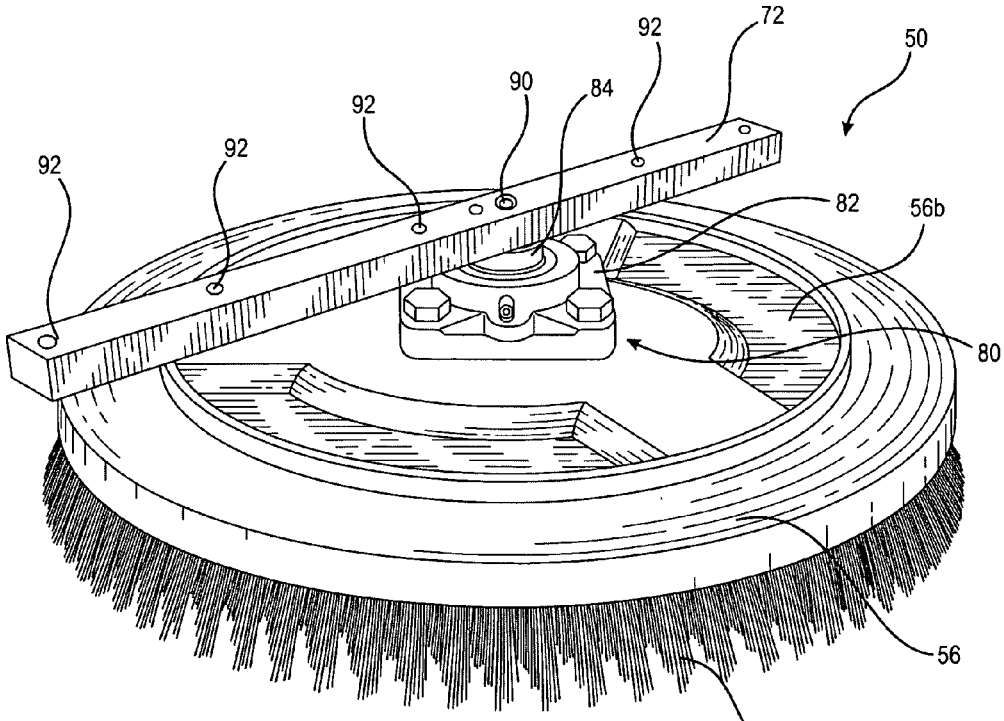
FIG. 5 is a top perspective view of a circular brush assembly showing a portion of the mounting means of a first embodiment of the present invention installed thereon.
Figure 4:
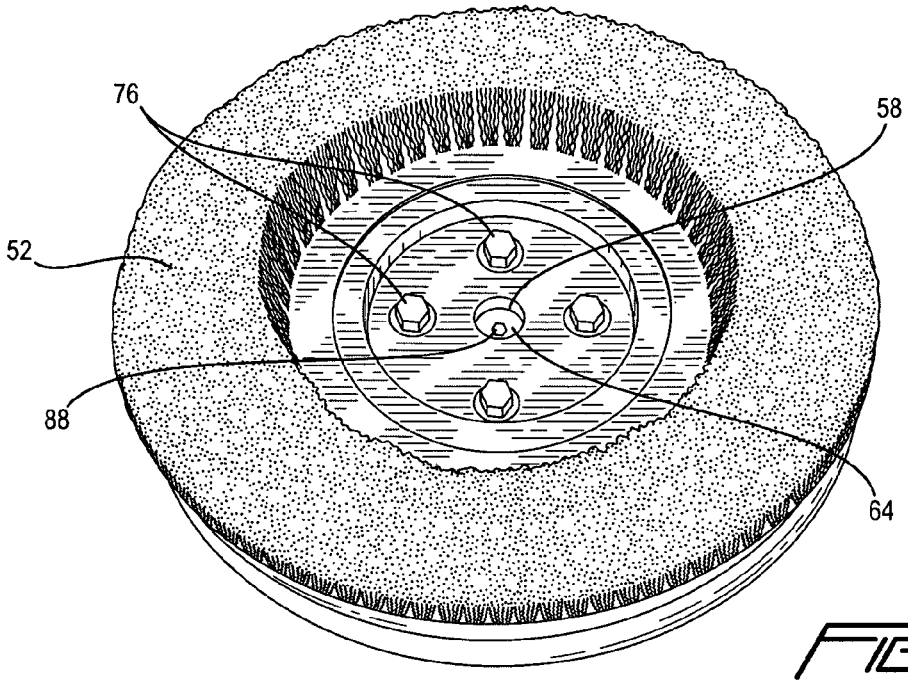
FIG. 4 is a bottom perspective view of a circular brush assembly showing a portion of the mounting means of a first embodiment of the present invention installed thereon.
Figure 8:
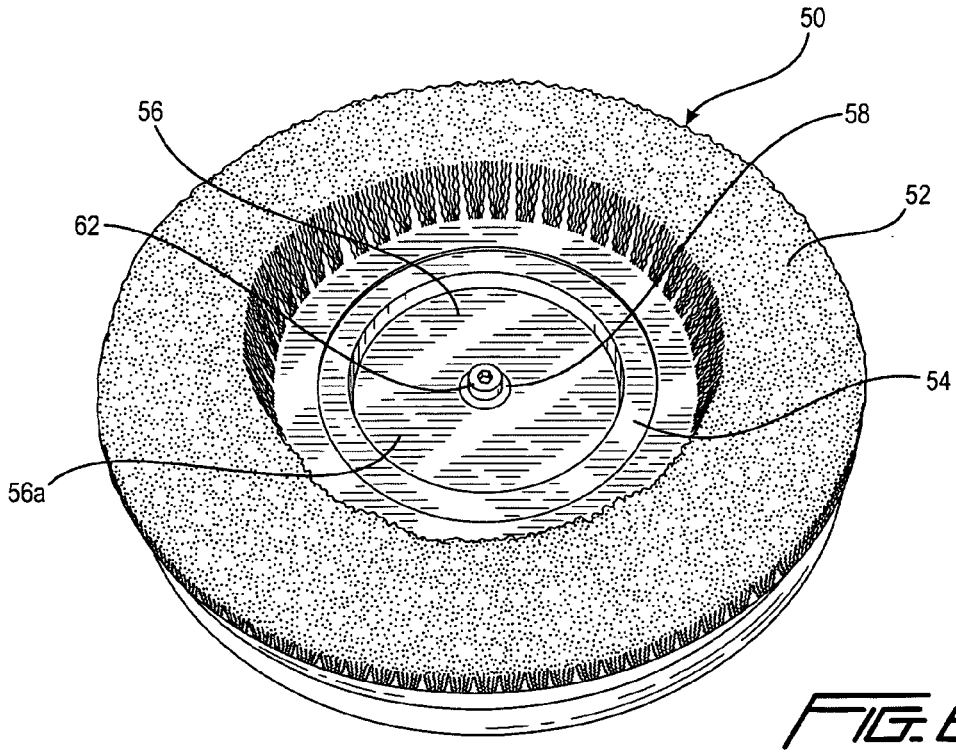
FIG. 8 is a bottom perspective view of a circular brush assembly showing a portion of the mounting means of a second embodiment of the present invention installed thereon.
Figure 6:
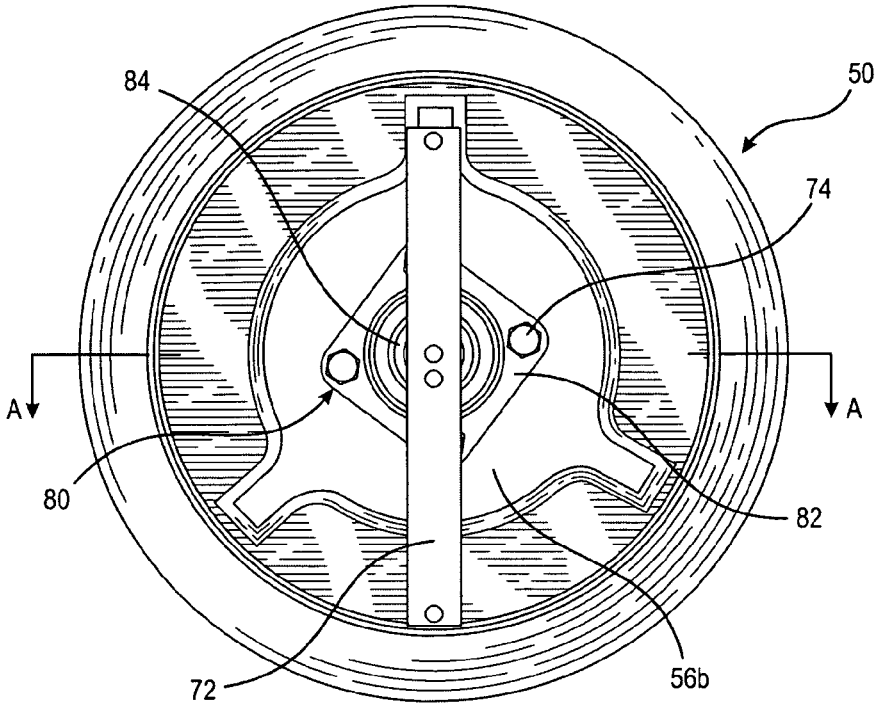
FIG. 6 is a top plan view of a circular brush assembly showing a portion of the mounting means of a first embodiment of the present invention installed thereon.
Figure 7:
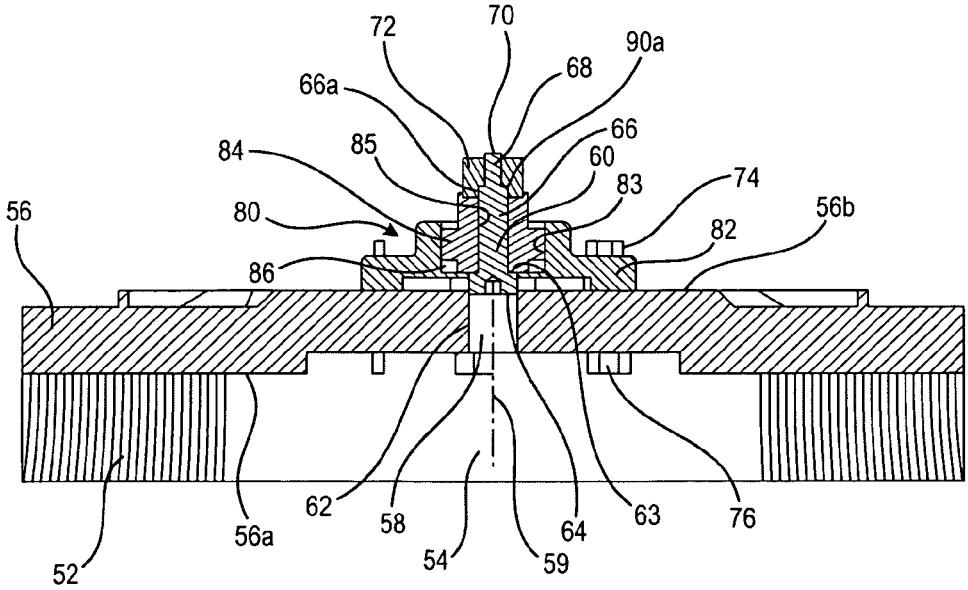
FIG. 7 is a partial sectional view taken along line A-A in FIG. 6.
Figure 9:
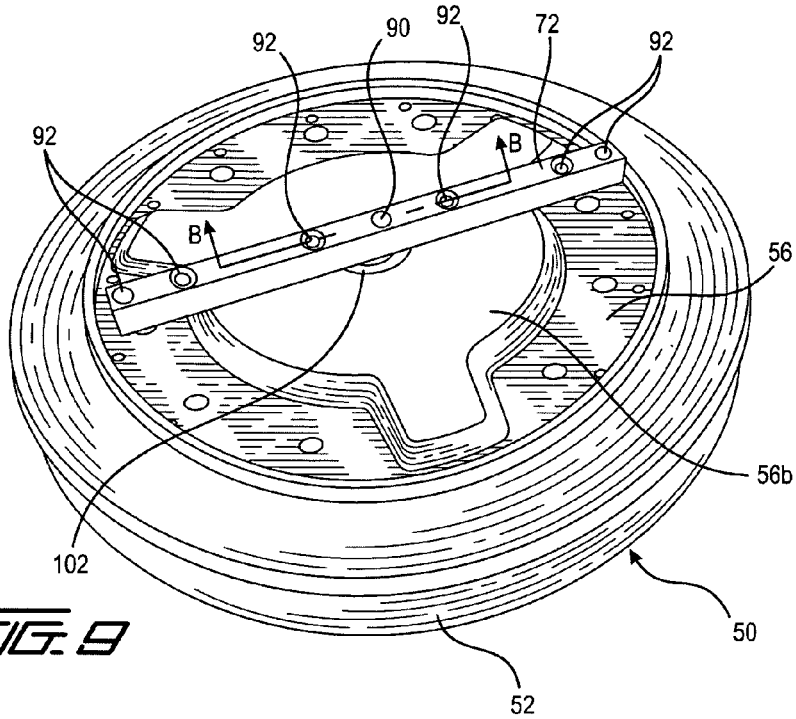
FIG. 9 is a top perspective view of a circular brush assembly showing a portion of the mounting means of a second embodiment of the present invention installed thereon.
Figure 10:
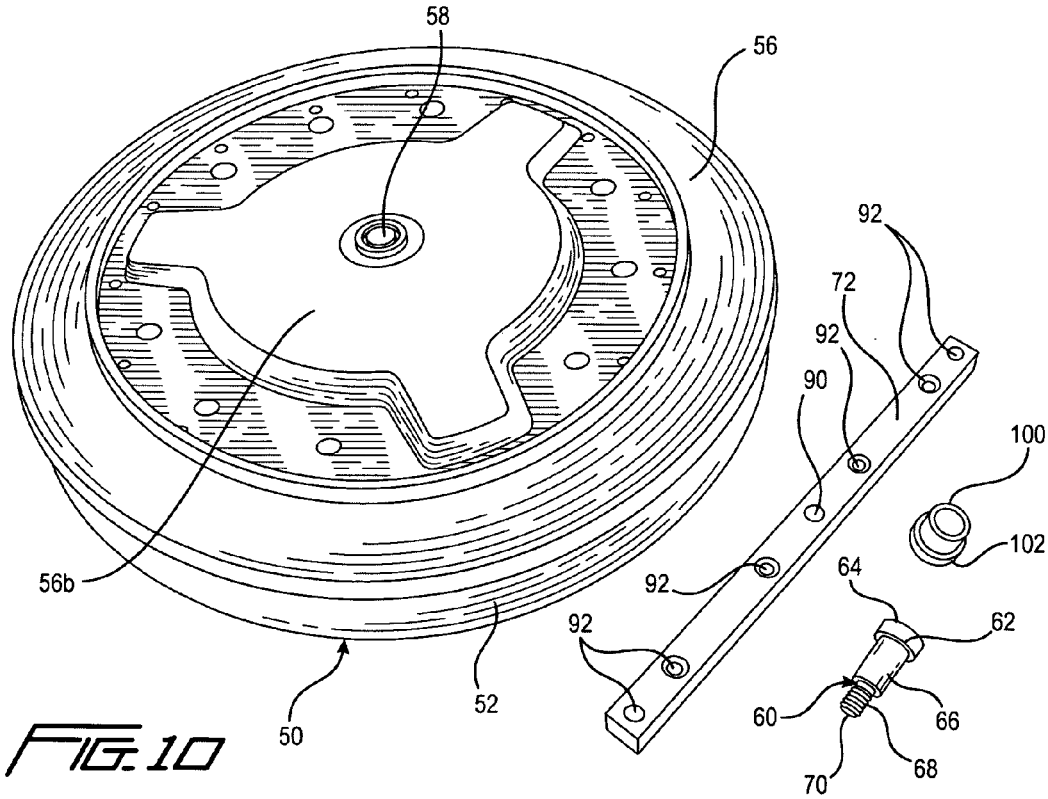
FIG. 10 is another top perspective view of a circular brush assembly showing the components of the mounting means of a second embodiment of the present invention.

Referring to FIG. 2 there is shown a conventional ride-on power trowel 10 comprising an operator seating and control station 12, an engine 14, at least two downwardly projecting rotor or spider assemblies 16, each assembly having a plurality of radially extending, spaced-apart arms and a trowel blade mounted on each arm for providing at least two sets of horizontal rotating blades encircled by a guard ring cage 18. A typical four arm spider assembly 30, suitable for use with either a ride-on or walk-behind power trowel, is illustrated in FIG. 3. The assembly includes four radially extending arms 32 emanating from a central hub 34, which receives a drive shaft (not shown). A trowel blade 36 is mounted via bolts 38 on each trowel arm 32. It will be appreciated that each rotor assembly may contain more or less than four arms for mounting trowel blades thereon, the number of arms being a matter of design choice.

It will also be appreciated that although the mounting means of the present invention will be described herein with reference to ride-on surface processing machines due to the unique advantage they offer in terms of square feet of concrete which can be finished per day, the mounting means can, of course, be used with walk-behind surface processing machines which also conventionally use downwardly projecting rotor or spider assemblies for mounting trowel blades. A typical walk-behind surface processing machine mounting trowel blades for finishing wet concrete is illustrated in FIG. 2 of the aforementioned U.S. Pat. No. 7,059,801.

The mounting means of the present invention will be described herein with reference to circular brushes; however, it will be appreciated that the mounting means can, of course, be used with other surface processing tools, such as scrubbers, buffers, grinders, polishers, and the like. Referring to FIGS. 4-7 there is shown a circular brush assembly 50 including a circular bristle brush 52 in the form of a ring having a hollow center 54 mounted to or with the bristles extending from the underside 56*a* of a brush cover plate 56, which has an upper surface 56*b* which may be flat or slightly convex. Cover plate 56 includes a central aperture 58 for receiving a mounting shank 60 therethrough. Shank 60 includes a head 62 at one end 64, a smooth surfaced, generally cylindrical shank portion 66 extending from head 62 to a point intermediate the ends of the shank 60 and a threaded portion 68 extending from the end of the smooth shank portion 66 to the end 70 of the shank opposite the shank head 62. A brush assembly 50 is mounted to one of the arms 32 of a spider assembly 30 by first mounting the brush assembly to a mounting means 72, such as an elongate mounting bar, which itself is mounted to the arm 32 of the spider assembly 30. Brush assembly 50 is mounted to mounting means 72 in a manner which allows brush assembly 50 to spin freely on its axis, as will be seen from the following description.

Initially a rotary bearing 80 is mounted, e.g., via bolts 74 and nuts 76, on the upper surface 56*b* of brush cover plate 56 and positioned thereon such that bearing 80 is concentric with central aperture 58. Bearing 80 may be any type of bearing, e.g., ball bearing, roller bearing, fluid bearing, magnetic bearing, etc., which will permit each of the brushes 52 on each arm 32 to spin freely about its mounting axis perpendicular to the arms. In a preferred embodiment, bearing 80 includes a stationary hub 82 having a central bore 83, which is mounted to the brush cover plate upper surface 56*b*, a rotating hub 84 having a central bore 85 mounted within the central bore 83 of stationary hub 82 and fluid bearing means 86 sealed within bearing 80 and between hubs 82, 84 to facilitate concentric rotation of the hubs about a common axis, which is the central axis 59 of central aperture 58. A threaded, radially extending lubrication port (not shown) is desirably formed in stationary hub 82 to facilitate the injection of lubricant, when required. The lubrication port is closed by a grease port through which the lubricant may be injected.

With bearing 80 bolted in place on the upper surface 56*b*, end 70 of mounting shank 60 is inserted into the central aperture 58 of cover plate 56 from the brush side of cover plate 56 and extends through central bore 85 of rotating hub 84 with threaded portion 68 and the upper end portion of smooth cylindrical shank portion 66 emerging from the central bore 85. The diameter of shank head 62 approximates the diameter of central aperture 58 but is slightly smaller so that the portion of head 62 which remains within central aperture 58 when shank 60 is fully inserted within rotating hub 82 does not frictionally engage the side walls of central aperture 58 as brush assembly 50 spins on mounting shank 60. Cylindrical shank portion 66 has a smaller diameter than shank head 62 to define an annular shoulder 63 therebetween which seats against the underside of rotating hub 84 when mounting shank 60 is fully inserted therewithin. Cylindrical shank portion 66 has a diameter which allows central aperture 58 of brush assembly 50 to rotate freely about shank head 62 with just enough play to allow bearing 80 to absorb forces encountered during use, such as brush 52 striking bumps on the floor or brush cover plate 56 impacting with walls, and the like. The threaded portion 68 projecting from rotating hub 84 is threaded into central threaded aperture 90 in mounting bar 72, which includes a counterbore 90*a* to receive upper end portion 66*a* of smooth cylindrical shank portion 66. In this manner, mounting shank 60 is firmly seated between the underside of rotating hub 84 and mounting bar 72. By having end portion 66*a* extend into counterbore 90*a*, the strength of the connection between mounting shank 60 and mounting bar 72 is greatly increased.

Shank 60 is so dimensioned that, when thus mounted, the smooth portion 66 of mounting shank 60 is rotationally closely adjacent the inner diameter of rotating hub 84 and the brush assembly 50 is securely mounted on mounting bar 72, yet is free to spin on the axis provided by mounting shank 60. A recessed aperture 88, such as a hexagonal aperture, is formed in end 64 of mounting shank 60 to facilitate threading mounting bar 72 onto threaded portion 68 of shank 60.

Additional apertures 92 are provided in mounting bar 72 for attaching the brush assembly 50 to the rotor arms of the power trowel using at least two bolts, which extend through the rotor arms and are received in apertures 92. An advantage of the present mounting adapter is that, by virtue of mounting bar 72, it permits the brush assembly 50 to be attached to the arms 32 of spider assembly 30 using multiple bolts to provide added strength and reduce wear at the area of greatest operational stress. In addition, inasmuch as the mounting adapter of the present invention will be used with spider assemblies of many different manufacturers, the mounting bar 72 serves as a readily interchangeable interface between the mounting adapter and the spider assembly and can be readily altered to suit the configuration and bolt hole locations of the spider assembly. It will be appreciated that the mounting means need not be a mounting bar, but can be any well known mounting means, such as a channel.

Referring to FIGS. 8-11 there is shown a second embodiment of the mounting adapter of the present invention. Features common to each of the embodiments are designated by the same reference numerals. Circular brush assembly 50 includes a circular bristle brush 52 in the form of a ring having a hollow center 54 mounted to or with the bristles extending from the underside 56*a* of a brush cover plate 56, which may be flat or slightly convex. Cover plate 56 includes a central aperture 58 for receiving a mounting shank 60 therethrough. Shank 60 includes a head 62 at one end 64, a smooth surfaced, generally cylindrical shank portion 66 extending from head 62 to a point intermediate the ends of the shank 60 and a threaded portion 68 extending from the end of the smooth shank portion 64 to the end 70 of the shank opposite the shank head 62. A brush assembly 50 is mounted to one of the arms 32 of a spider assembly 30 by first mounting the brush assembly to a mounting means 72, such as an elongate mounting bar, which itself is mounted to the arm 32 of the spider assembly 30. Brush assembly 50 is mounted to mounting means 72 in a manner which allows brush assembly 50 to spin freely on its axis, as will be seen from the following description.

Initially a hollow cylindrical sleeve 100 is inserted through the central aperture 58 of cover plate 56 toward the hollow center 54 of brush assembly 50. One end of sleeve 100 has a circular flange 102 extending radially outwardly from the sleeve periphery to define a collar which seats upon the top side 56*b* of brush cover plate 56, to prevent the sleeve 100 from falling through aperture 58, while the cylindrical length of sleeve 100 extends into central aperture 58 toward the hollow center 54 of brush assembly 50. Mounting shank 60 is inserted into sleeve 100 from the brush side of cover plate 56 with shank head 62 overlying the end of sleeve 100 at the underside 56*a* of brush cover plate 56. The threaded portion 68 and the upper end portion 66*a* of smooth cylindrical shank portion 66 emerge from the collared end of sleeve 100. The threaded portion 68 projecting from sleeve 100 is threaded into central threaded aperture 90 in mounting bar 72, which includes a counterbore 90*a* to receive upper end portion 66*a* of smooth cylindrical shank portion 66. By having end portion 66*a* extend into the counterbore 90*a*, the strength of the connection between mounting shank 60 and mounting bar 72 is greatly increased.

Shank 60 is so dimensioned that, when thus mounted, the smooth portion 66 of mounting shank 60 is rotationally closely adjacent the inner diameter of sleeve 100 and the brush assembly is securely mounted on mounting bar 72, yet is free to spin on the axis provided by mounting shank 60. Desirably, with the brush assembly 50 securely threaded into aperture 90 of mounting bar 72, the length of the mounting shank between the underside of shank head 62 and the surface of mounting bar 72 adjacent the top side 56*b* of cover plate 56 is about 1/16 inch longer than the length of sleeve 100 to provide the free space S necessary for brush assembly 50 to be able to freely spin about mounting shank 60.

As with the first embodiment, additional apertures 92 are provided in mounting bar 72 for attaching the brush assembly 50 to the rotor arms of the power trowel using at least two bolts, which extend through the rotor arms and are received in apertures 92. An advantage of the present mounting adapter is that, by virtue of mounting bar 72, it permits the brush assembly 50 be attached to the arms 32 of spider assembly 30 using multiple bolts to provide added strength and reduce wear at the area of greatest operational stress. In addition, inasmuch as the mounting adapter of the present invention will be used with spider assemblies of many different manufacturers, the mounting bar 72 serves as a readily interchangeable interface between the mounting adapter and the spider assembly and can be readily altered to suit the configuration and bolt hole locations of the spider assembly. It will be appreciated that the mounting means need not be a mounting bar, but can be any well known mounting means, such as a channel.

While the present invention has been described in terms of specific embodiments thereof, it will be understood that no limitations are intended to the details of construction or design other than as defined in the appended claims.

The invention claimed is:

1. A mounting assembly for rotatably mounting a tool holding means comprising a tool holder body having first and second surfaces on at least one motor driven rotatable arm of a surface processing apparatus, a surface processing tool mounted on said first surface and an aperture extending through said first and second surfaces, said surface processing tool having an axis substantially parallel to the axis of rotation of said motor driven arm, said tool axis passing through said aperture of said tool holder body, whereby said surface processing tool can spin freely about its axis as said arm is rotatably driven by said motor, said mounting assembly comprising:

elongate unitary shank means including an elongate smooth surfaced, generally cylindrical shank portion intermediate the ends of said shank means, said shank means adapted for positioning within said aperture with one end projecting through said second surface of said tool holder body;

bearing means supported by said second surface of said tool body, said bearing means having a bore surrounding, in closely adjacent relationship, said smooth surfaced portion of said shank means;

said bearing means being rotatable relative to said shank means for rotatably mounting said surface processing tool, whereby said surface processing tool can spin freely about its axis, said bearing means comprising the only bearing means on which said surface processing tool rotates; and elongate mounting means adapted for attachment to said arm, said one end of said elongate shank means including means for non-rotatable attachment to said mounting means.

2. A mounting assembly, as claimed in claim 1, wherein said elongate shank means includes a head at one end of said smooth surfaced portion and a threaded end portion at the opposite end of said smooth surfaced portion.

3. A mounting assembly, as claimed in claim 2, wherein said elongate mounting means includes a threaded aperture for receiving said threaded end portion of said shank means within said threaded aperture and said threaded aperture includes a counterbore for receiving the end portion of said smooth surfaced portion which is adjacent said threaded end portion.

4. A mounting assembly, as claimed in claim 3, wherein said elongate mounting means includes at least two additional apertures for receiving connecting means connecting said elongate mounting means to said arm.

5. A mounting assembly, as claimed in claim 2, wherein said bearing means includes first and second relatively rotatable, concentric hubs, said first hub being supported by said second surface of said tool holder body such that said bearing means is concentric with said aperture therein.

6. A mounting assembly, as claimed in claim 5, wherein said first hub has a first central bore, said second hub has a second central bore concentric with said first central bore and is mounted within said first central bore.

7. A mounting assembly, as claimed in claim 6, wherein said elongate shank means extends through said second central bore with the threaded end portion of said shank and the end portion of said smooth surfaced portion which is adjacent said threaded end portion projecting from said second central bore.

8. A mounting assembly, as claimed in claim 7, wherein said elongate mounting means includes a threaded aperture for receiving said threaded end portion of said shank means within said threaded aperture and said threaded aperture includes a counterbore for receiving the end portion of said smooth surfaced portion which is adjacent said threaded end portion.

9. A mounting assembly, as claimed in claim 7, wherein said smooth surfaced portion has a smaller diameter than said shank head for defining a shoulder therebetween, said shoulder abutting said second hub when said shank is fully threaded within said mounting means.

10. A mounting assembly, as claimed in claim 7, wherein the diameter of the shank head is smaller than the diameter of the aperture.

11. A mounting assembly, as claimed in claim 1, wherein said elongate mounting means is an elongate bar.

12. A mounting assembly, as claimed in claim 1, wherein said surface processing tool is selected from scrubbing tools, buffing tools, brushing tools, grinding tools and polishing tools.

13. A mounting assembly, as claimed in claim 1, wherein said surface processing tool comprises a circular brush in the form of a ring having a hollow center.

14. A mounting assembly, as claimed in claim 2, wherein said bearing means comprises a hollow cylindrical, elongate sleeve having an outside diameter smaller than the diameter of said aperture in said tool holding means and means on said sleeve for maintaining said sleeve within said aperture.

15. A mounting assembly, as claimed in claim 14, wherein said means on said sleeve comprises a circular flange extending radially outwardly from the periphery of one end of said sleeve.

16. A mounting assembly, as claimed in claim 15, wherein said elongate shank means extends through said sleeve with the threaded end portion of said shank and the end portion of said smooth surfaced portion which is adjacent said threaded end portion projecting from said sleeve.

17. A mounting assembly, as claimed in claim 16, wherein said elongate mounting means includes a threaded aperture for receiving said threaded end portion of said shank means within said threaded aperture and said threaded aperture includes a counterbore for receiving the end portion of said smooth surfaced portion which is adjacent said threaded end portion.

18. A mounting assembly, as claimed in claim 17, wherein the length of said shank means between the underside of said shank head and the surface of said mounting means adjacent said second surface of said tool holding means is slightly longer than the length of said sleeve to allow said surface processing tool to freely spin about said shank means.

* * * * *